United States Patent [19]

Lameyer

[11] 4,246,046

[45] Jan. 20, 1981

[54] STAINLESS STEEL CONTAINER FOR FLUID AND METHOD

[76] Inventor: Michael Lameyer, P.O. Box 2643, Palm Beach, Fla. 33480

[21] Appl. No.: 19,172

[22] Filed: Mar. 9, 1979

Related U.S. Application Data

[63] Continuation of Ser. No. 915,282, Jun. 13, 1978, abandoned.

[51] Int. Cl.[3] ..... C22C 38/40

[52] U.S. Cl. ..... 148/12 E; 75/128 T; 148/37

[58] Field of Search ..... 75/128 T; 148/12 E, 148/12 EA, 37, 38, 135, 136, 142, 12.3; 220/3

[56] References Cited

U.S. PATENT DOCUMENTS

| | | | |
|---|---|---|---|
| 2,541,065 | 2/1951 | Jabour | 220/3 |
| 3,258,370 | 6/1966 | Floreen et al. | 148/12 E |
| 3,723,102 | 3/1973 | Lowe | 75/128 T |
| 3,759,757 | 9/1973 | Perry | 75/128 T |
| 3,795,509 | 3/1974 | Mimino et al. | 75/128 T |
| 3,837,847 | 9/1974 | Bieber | 75/128 T |

*Primary Examiner*—L. Dewayne Rutledge
*Assistant Examiner*—Peter K. Skiff
*Attorney, Agent, or Firm*—Sherman & Shalloway

[57] ABSTRACT

A unitary integral tank for fluids, such as air or other gasses in diving tanks, having one end thereof formed to be self supporting or standing and the other end thereof tapped for threaded engagement with valves; the cross section of said tank being substantially circular with thickened end portions for strength. The tank is fabricated from a stainless steel material containing in excess of 16.5% chromium, and in excess of 24% of chromium, manganese and nickel combined.

3 Claims, 4 Drawing Figures

STAINLESS STEEL CONTAINER FOR FLUID AND METHOD

This is a continuation of application Ser. No. 915,282, filed June 13, 1978, abandoned.

BACKGROUND OF THE INVENTION

This invention relates to containers for holding fluids under extreme high pressures and, more particularly, to a container for diving or other gas containing tanks formed of stainless steel alloy that ruptures along split lines under excessive pressures rather than fragmenting.

Tanks used for fluids such as air or other gases and mixtures thereof are often subjected to considerable stress both because of the high pressures of the fluids within the tanks and because of pressures exerted due to conditions during the handling and use of such tanks. Where a tank is used to dispense oxygen in a hospital or on an emergency vehicle, as well as in applications such as for scuba diving, rough handling or extreme conditions of an environmental nature may occur. It will be appreciated that a rupturing of such tanks may pose serious threats of injury to a user if the rupture results in fragmentation of the tank. Accordingly, it is important that such tanks rupture without fragmentation if they are subjected to extremely abnormal conditions. Moreover, it is important to provide as much tensile strength as possible.

In this latter connection, such tanks can be increased in strength by manufacturing them with heavier walls. However, this solution may result in an extremely heavy tank unsuitable for application requiring portability. Also, the fragmentation problem due to the characteristics of the material of the tank may still be present.

Accordingly, it is an object of this invention to provide a high pressure container which will be light in weight and substantially symetrical in design and which will be corrosive resistant and upon failure split instead of fragmenting.

Another object of this invention is to provide a high compression tank, for scuba divers, in which the tank is of unitary integral construction from a corrosive resisting alloy having in excess of 16.5% chromium and in excess of 24% combination of chromium, manganese and nickel, which container is then annealed by heat treating to provide a container having in excess of 110,000 p.s.i. yield stress, and upon failure splits and does not fragment.

A more specific object of this invention is to provide a novel method for producing a high strength tank for fluids which is of unitary, integral construction and is formed from an alloy which by weight consists essentially of about 16.18% chromium, about 7.89% nickel, about 0.8% titanium, about 0.4% aluminum, up to about 0.5% silicon, about 0.88% manganese, about 0.04% sulphur, about 0.04% phosphorus, up to about 0.04% carbon and balance iron.

BRIEF DESCRIPTION OF THE DRAWINGS

The foregoing and other object and advantages of this invention will be more apparent from the following specification, taken in conjunction with the drawings, forming a part thereof, wherein.

DETAILED DESCRIPTION

Figure 1:
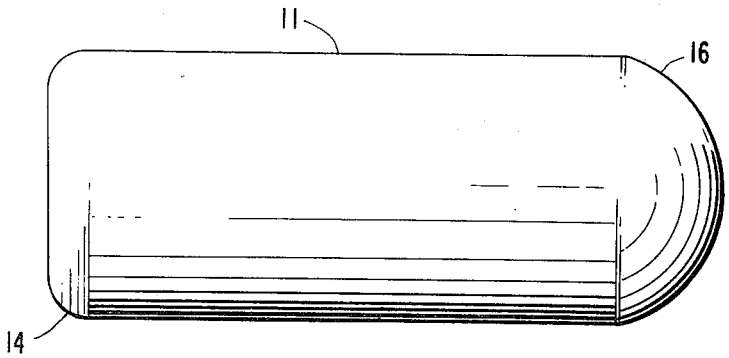
FIG. 1 is a side elevation of the high pressure container.
Figure 2:
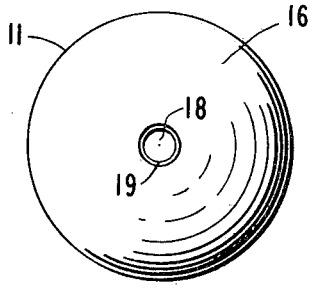
FIG. 2 is a plan view of the top of the high pressure container.
Figure 3:
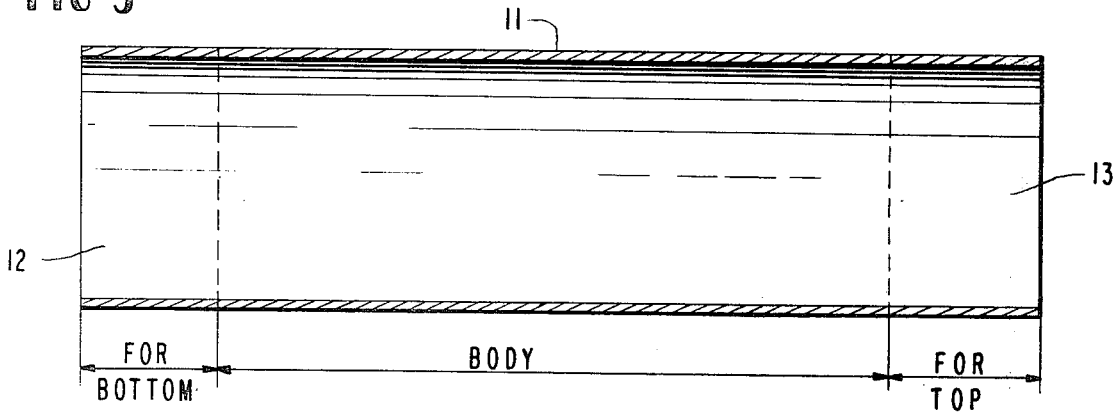
FIG. 3 is a cross-sectional view of the seamless tube used in the production of the container; and, FIG. 4 is an enlarged sectional view of the tank with portions of the central section removed.
Figure 4:
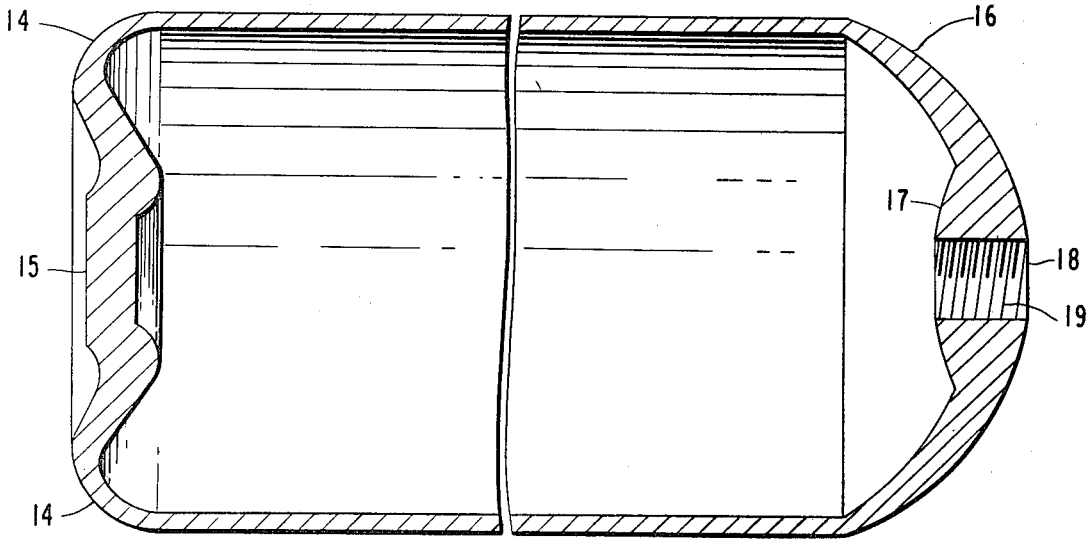

Referring to the drawings, wherein like members are given the same reference numberal, a stainless steel alloy containing in excess of 16.5% chromium and a combination of chromium, manganese and nickel in excess of 24% is drawn into a seamless tube 11 having a predetermined length for a desired standard size tank. From the two end portions 12 and 13, the bottom and top of the unitary integral tank are formed by heat spinning. In this regard, U.S. Pat. No. 1,420,721 to McNiff, and U.S. Pat. No. 2,026,133 to Mapes, teach methods of heat spinning that are suitable to seal the ends.

The end 12 is heated uniformally to produce a uniform plasticity of the metal which is then bent inwardly at 14 to assume a radial relationship to the side walls of the tube. A forming anvil may be held in place within the tube while a coating forming tool or press tool compresses the outside of the portion 12 to form a thickened bottom member 15. By the configuration of the bottom member, it may be stood on end and be self supporting and standing.

The other end 13 of the tube is heated and spin formed in a similar manner to end 12, to provide an arcuate rounded surface for the end member 16 with a thickened central portion 17. In the center of the thickened portion 17 a tapped aperture 18 is provided with the threads 19 to receive, by threaded engagement, a conventional pressure regulating and release valve assembly, well known in the art of pressure tanks.

The tanks, when formed, are preferably annealed or heat treat at 900° to 950° Fahrenheit from two to three hours. The higher the temperature the lower the treating time. At temperatures above 950° Fahrenheit and treatments in excess of 3 hours reduces the tensile strength and also makes the alloy more brittle so that it tends to fragment rather than split.

Various stainless steel alloys have been tested, but a high chromium percentage in excess of 16.5% and a combination of chromium, nickel and manganese in excess of 24% appears to be essential to obtain the desired tensile strength and splitting characteristic without fragmentation.

| COMPONENT | EXAMPLE #1 | EXAMPLE #2 | PREFERRED RANGE |
|---|---|---|---|
| Cr | 16.89 | 17.34 | 16.50–18.00 |
| Ni | 7.59 | 7.89 | 7.20–8.00 |
| Ti | 0.79 | 0.80 | 0.75–0.85 |
| Al | 0.28 | 0.33 | 0.25–0.35 |
| Si | 0.40 | 0.35 | 0.25–0.40 |
| Mn | 0.84 | 0.88 | 0.75–0.90 |
| S | 0.035 | 0.040 | 0.030–0.045 |
| P | 0.036 | 0.038 | 0.030–0.045 |
| C | 0.036 | 0.036 | up to–0.040 |

All the above members represent percentage of the components by weight with the balance of the composition being iron. With the foregoing compositions, the following results were obtained by standard 0.2% offset testing techniques:

| MEASUREMENT | TEST #1 | TEST #2 | TEST #3 | TEST #4 |
|---|---|---|---|---|
| YIELD POINT LOAD (LBS) | 26,200 | 28,000 | 27,200 | 28,200 |
| ULTIMATE LOAD (LBS) | 30,000 | 32,850 | 31,850 | 32,200 |
| YIELD STRESS (LBS/SQ.IN) | 117,400 | 115,400 | 115,450 | 116,200 |
| ULTIMATE STRENGTH (LBS/SQ.IN) | 134,400 | 135,350 | 135,200 | 132,700 |

In reducing the chromium content below about 16.5% the tensile strength appears to be substantially diminished, as also occurs in diminishing the combination of chromium, nickel and manganese below about 24%. The heat treating, curing or annealing process appears to be essential within the temperature limits and the time limits as described.

The present invention may be embodied in other specific forms without departing from the spirit or essential characteristics thereof. The presently disclosed exemplary embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method of forming a tank for holding fluids under high pressure comprising:

forming a unitary integral tank with one end being self supporting and the other end adapted to receive an output means by shaping the tank from an alloy consisting of the following percentages materials by weight of:

| | |
|---|---|
| Cr | 16.50–18.00 |
| Ni | 7.20–8.00 |
| Ti | 0.75–0.85 |

-continued

| | |
|---|---|
| Al | 0.25–0.35 |
| Si | 0.25–0.40 |
| Mn | 0.75–0.90 |
| S | 0.030–0.045 |
| P | 0.030–0.045 |
| C | up to - 0.045 |
| Balance Iron; and, | |

heat treating the formed tank at about 900° F. to 950° for less than 3 hours, to provide a yield stress in excess of 110,000 p.s.i. and which upon failure splits and does not fragment.

2. A method according to claim 1 wherein the tank is formed from an alloy consisting of the following percentages of material by weight:

| | |
|---|---|
| Cr | 16.89 |
| Ni | 7.59 |
| Ti | 0.79 |
| Al | 0.28 |
| Si | 0.40 |
| Mn | 0.84 |
| S | 0.035 |
| P | 0.036 |
| C | 0.036 |
| Balance Iron. | |

3. A method according to claim 2 wherein the tank is formed from an alloy consisting of the following percentages of material by weight:

| | |
|---|---|
| Cr | 17.34 |
| Ni | 7.89 |
| Ti | 0.80 |
| Al | 0.33 |
| Si | 0.35 |
| Mn | 0.88 |
| S | 0.040 |
| P | 0.038 |
| C | 0.036 |
| Balance Iron | |

* * * * *